United States Patent [19]

Salice

[11] Patent Number: 5,033,160

[45] Date of Patent: Jul. 23, 1991

[54] HINGE, PREFERABLY FOR HINGING A DOOR OR FLAP TO A CARRYING WALL OF A FURNITURE CORPUS

[75] Inventor: Luciano Salice, Carimate, Italy

[73] Assignee: Arturo Salice S.p.A., Novedrate, Italy

[21] Appl. No.: 522,900

[22] Filed: May 14, 1990

[30] Foreign Application Priority Data

May 19, 1989 [DE] Fed. Rep. of Germany ..... 3916348
Mar. 21, 1990 [DE] Fed. Rep. of Germany ..... 4009126

[51] Int. Cl.[5] ..... E05D 7/00

[52] U.S. Cl. ..... 16/240; 16/346; 16/358; 16/360; 16/371; 16/382; 16/DIG. 43

[58] Field of Search ..... 16/240, 246, 346, 357, 16/370, 371, 382, DIG. 43, 364, 343, 358

[56] References Cited

U.S. PATENT DOCUMENTS

| | | | |
|---|---|---|---|
| 1,965,316 | 5/1933 | Predmore . | |
| 3,673,635 | 7/1972 | Cencioni | 16/368 |
| 3,978,549 | 9/1976 | Vitt | 16/370 |
| 4,091,501 | 5/1978 | Lautenschlager et al. | 16/357 |
| 4,701,979 | 10/1987 | Salice | 16/346 |
| 4,736,491 | 4/1988 | Mertes | 16/368 |

FOREIGN PATENT DOCUMENTS

| | | | |
|---|---|---|---|
| 478975 | 11/1969 | Austria | 16/358 |
| 343001 | 5/1978 | Austria . | |
| 637723 | 11/1936 | Fed. Rep. of Germany . | |
| 1559815 | 1/1970 | Fed. Rep. of Germany | 16/357 |
| 2303985 | 8/1974 | Fed. Rep. of Germany | 16/364 |
| 2405604 | 8/1975 | Fed. Rep. of Germany . | |
| 2511201 | 9/1976 | Fed. Rep. of Germany | 16/371 |
| 2524532 | 12/1976 | Fed. Rep. of Germany | 16/360 |
| 2749288 | 11/1978 | Fed. Rep. of Germany . | |
| 2823090 | 11/1979 | Fed. Rep. of Germany | 16/357 |
| 3100526 | 12/1981 | Fed. Rep. of Germany . | |
| 3442421 | 1/1985 | Fed. Rep. of Germany . | |
| 3344592 | 3/1985 | Fed. Rep. of Germany . | |
| 3442421 | 1/1986 | Fed. Rep. of Germany . | |
| 2053072 | 4/1971 | France . | |
| 2049800 | 12/1980 | United Kingdom | 16/360 |

*Primary Examiner*—Kurt Rowan
*Assistant Examiner*—Edward A. Brown
*Attorney, Agent, or Firm*—Fleit, Jacobson, Cohn, Price, Holman & Stern

[57] ABSTRACT

A hinge, preferably for hinging a door or flap to a carrying wall of a furniture corpus, comprises a cup-shaped hinged hinge member and a hinge bracket, which is articulately connected to the hinge member by two links and is adapted to be mounted on the carrying wall by a carrying plate. The hinge bracket is movably mounted at one end on the carrying plate by a guide, and one of the two links is extended in length beyond the pivot pin by which the one link is mounted on the hinge bracket. At the free end of the extension, the hinge bracket is articulately connected to the carrying plate so that a pivotal movement of the hinged hinge member will impart to the hinge bracket a displacement along its guide and a pivotal movement.

13 Claims, 4 Drawing Sheets

HINGE, PREFERABLY FOR HINGING A DOOR OR FLAP TO A CARRYING WALL OF A FURNITURE CORPUS

BACKGROUND OF THE INVENTION

1. Field of the Invention

This invention relates to a hinge, preferably for hinging a door or flap to a carrying wall of a furniture corpus, comprising a cup-shaped hinged hinge member and a hinge bracket, which is articulatedly connected to the hinge member by two links and is adapted to be mounted on the carrying wall by a carrying plate.

2. Description of the Prior Art

Such a hinge has been disclosed, e.g., in German Patent Specification 34 42 421 and in corresponding U.S. Pat. No. 4,701,979, the disclosure of which is incorporated herein by reference. During an opening movement of a door which is hinged by such a hinge, the door performs a pivotal movement, during which also the outer edge of the narrow end face on the hinge side of the door is moved outwardly beyond the space which is occupied by the end portion of the door when it is closed. That movement can usually be tolerated because under normal conditions the narrow end face on the hinge side of the door is adjoined by a free space or because a sufficiently large gap is provided between said end face and the adjacent end face of an adjacent door or other adjacent structural part. As a result, under such conditions, the outer edge of the narrow end face will not strike against an obstacle as the door is opened. But problems may arise if, for instance, a thick door is separated only by a narrow gap from an adjacent door or an adjacent structural part, or if ornamental bars or other ornamental elements have been mounted on the outside broadside of the door, so that the door has a larger thickness or is provided with projections in said region.

Published German Application 31 00 526 discloses a hinge in which the hinged hinge member is held by two links, one of which is guided by means of side pins in a guide slot, which is formed in the rear portions of side portions of the base plate. A slider is guided in side grooves of the bipartite link and is articulatedly connected by the other link to the hinged hinge member. Pins are carried by the intermediate portion of the first link and extend through a V-shaped slideway of the base plate and carry pins, which mesh with rack portions of the base plate and of the slider. As the first link and the slider, which is connected to the second link, are pulled away from the base plate, the slideway, owing to its V-shaped curvature, will impart to the first link a pivotal movement relative to the base plate and the hinged hinge member can thus be pivotally moved through an angle of about 180 degrees. However, this known hinge does not constitute a four-pivot hinge of the kind described first hereinbefore, and the displacement and pivotal movement can be imparted to the first link only by slideways, which constitute two tracks, and expensive means for transmitting motion.

In the hinge disclosed in German Patent Specification 637,723, a movable hinge arm is provided with a link, which is articulatedly connected to a slider, which is longitudinally slidably guided in the fixed hinge arm. At its free end, the link is articulatedly connected to a further link, which, at its other end, is pivoted to the fixed hinge arm adjacent to the rear end of the guide for the slider. This known hinge is also not a four-pivot hinge of the kind described first hereinbefore, and its movable hinge arm is pivoted to a slider, which is longitudinally slidably connected to the fixed hinge arm, which is not adapted to perform a pivotal movement in addition to its translational movement.

Published German Application 27 49 288 discloses a wide-angle hinge which has links crossing like scissors and in which one of the crossing links is articulatedly connected at its forward end to the hinged hinge member, whereas the rear end of the link is articulatedly connected by a coupling member to a rising portion at the rear end of the carrying plate.

SUMMARY OF THE INVENTION

For these reasons, it is an object of the invention to provide a hinge of the kind described first hereinbefore which permits an opening of the door to a large extent without an obstruction, even if the door is thick or if there is a large distance between the bore of fixation of the hinged hinge member and the end face on the hinge side of the door and if there is only a narrow gap between the door and an adjacent door or wall, or if the door is additionally provided with ornamental bars or the like.

In a hinge which is of the kind described first hereinbefore, that object is accomplished in accordance with the invention in that the hinge bracket is movably mounted at one end on the carrying plate by a guide and one of the two links is extended in length beyond the pivot pin by which said one link is mounted on the hinge bracket and at the free end of said extension is articulatedly connected to the carrying plate so that a pivotal movement of the hinged hinge member will impart to the hinge bracket a displacement along its guide and a pivotal movement.

During a pivotal movement of the hinged hinge member of the hinge in accordance with the invention to the open position, the hinge bracket of said hinge will perform an inward pivotal movement and will be displaced outwardly at the same time. As a result, the opening movement of the door will be accompanied by a substantial widening of the gap which exists between the hinge-side end face of the door and an adjacent structural part, and the gap existing between the inner broadside of the door and the end face of the carrying wall which carries the door. This means that the hinge bracket performs a pivotal movement in a sense which is opposite to the pivotal movement of the door and the hinge bracket will be displaced outwardly at the same time. As a result, during an opening movement of the door from its closed position, the edge portion of the door on the hinge side thereof will be displaced inwardly and, in addition, outwardly, so that there will be a sufficiently large free space even if the door has a considerable thickness or is provided with ornamental bars or the like.

Because, in the hinge in accordance with the invention, an opening movement of the door will impart to the hinge bracket a translational movement toward the outside and a superimposed pivotal movement in a sense which is opposite th the pivotal movement of the door, it is sufficient to design the hinged hinge member, by which the door is mounted to have only a small thickness so that the hinge, in accordance with the invention, may also be designed as a hinge for glass doors.

Owing to the movable mounting of the hinge bracket, the hinge, in accordance with the invention, permits the door to be opened through a large angle. Although that angle is smaller than the angle of the opening movement which is permitted by so-called wide-angle hinges, the hinge, in accordance with the invention, is more compact and robust, and occupies a smaller space and is less expensive, than such wide-angle hinges.

In the embodiments of the hinge in accordance with the invention, a pivotal movement of the hinged hinge member to its open position will cause the hinge bracket to perform an inward pivotal movement and to be displaced outwardly at the same time. As a result, the opening movement of the door will be accompanied by a substantial widening of the gap which exists between the hinge-side end face of the door and an adjacent structural part and the gap existing between the inner broadside of the door and the end face of the carrying wall which carries the door. This means that the hinge bracket performs a pivotal movement in a sense which is opposite to the pivotal movement of the door, and the hinge bracket will be displaced outwardly at the same time. As a result, during an opening movement of the door from its closed position, the edge portion of the door on the hinge side thereof will be displaced inwardly and, in addition, outwardly so that there will be a sufficiently large free space, even if the door has a considerable thickness or is provided with ornamental bars or the like. But in the embodiments, the pivotal movement of the hinge bracket, in a sense which is opposite to the pivotal movement of the door, will have the result in that the largest angle through which the door can be opened is somewhat smaller than the largest angle which would be permitted by the articulating system. That angle is decreased because the hinge bracket performs an inward pivotal movement.

A full utilization of the angle of the opening movement of the door which is permitted by the articulating system is provided by a further feature of the invention. Specifically the articulated connection provided adjacent to the rear end of the hinge bracket is constituted by a coupling member, which, adjacent to the rear end of the hinge bracket, is articulatedly connected to the hinge bracket and to the carrying plate or intermediate plate. The coupling member has such a length that during a pivotal movement of the hinged hinge member to the open position, the hinge bracket will perform a pivotal movement, and during that pivotal movement will remain substantially parallel to the carrying plate. In the hinge in accordance with the invention, the range of the angular movement which is inherently permitted by the articulating system is not decreased, in that the hinge bracket performs a pivotal movement in a sense which is opposite to the pivotal movement of the door. Under certain circumstances, it may be desirable to provide a coupling member which has a smaller or larger length or which has such a length that the hinge bracket will perform a pivotal movement in the same sense as the door as the latter is opened. In that case the angle of the opening movement which is permitted will be further increased. In the hinge in accordance with the invention, the hinge bracket will not perform a pivotal movement in a sense which is opposite to the pivotal movement of the door, the hinge bracket will perform only a small pivotal movement which is opposite to the pivotal movement of the door, or the hinge bracket will perform a pivotal movement in the same sense as the door moving to its open position. The sense and extent of the pivotal movement of the hinge bracket will depend on the length of the rear coupling member relative to the length of the extension of the link.

In a special embodiment of the invention, the hinge has, for the opening pivotal movement, a characteristic which is entirely different from the corresponding characteristic provided in the wide-angle hinge disclosed in Published German Application 27 49 288 discussed hereinbefore. When the hinge of that embodiment is closed, the articulated connection between the coupling member and the hinge bracket is closer to the surface on which the carrying plate is mounted than the articulated connection between the coupling member and the carrying plate or intermediate plate. Because, in accordance with the invention, the hinge bracket is linked to the carrying plate or intermediate plate by forward and rear coupling members, the movement of the hinge bracket has the characteristic which is called for by the object. During a pivotal movement of the hinged hinge member, that pivot of the rear coupling member which is connected to the hinge bracket and is closer to the corpus wall will initially move toward the door in a direction which is approximately parallel to the corpus wall and that pivot will be more strongly lifted from the corpus wall only toward the end of the pivotal movement. The inside broadside of the door lies flat on the end face of the corpus part when the door is closed and, owing to the characteristic of the pivotal movement, that inside surface of the door will initially be strongly lifted from the end face of the corpus part at the beginning of the opening movement and a substantial pivotal movement of the door to its open position will not be performed until the door is sufficiently spaced from the end face of the corpus part and the hinge bracket will be displaced inwardly at the same time, so that a large angular opening movement can be performed without an obstruction by adjacent structural parts. For this reason the hinge in accordance with the invention is particularly suitable for a mounting of doors which have a considerable thickness or are provided with ornamental bars.

The coupling member is suitably pivoted to a rear rising part of the carrying plate or intermediate plate.

In the closed position of the hinge the coupling member and the extension of the link are preferably approximately parallel to each other.

The pivotal axes of the coupling member and of the extension of the link are preferably disposed at the corners of a parallelogram.

The coupling member consists suitably of a U-shaped member, which, has a web and legs, which adjacent to said web, are pivoted to the carrying plate or intermediate plate.

DETAILED DESCRIPTION OF THE PREFERRED EMBODIMENTS

Figure 1:
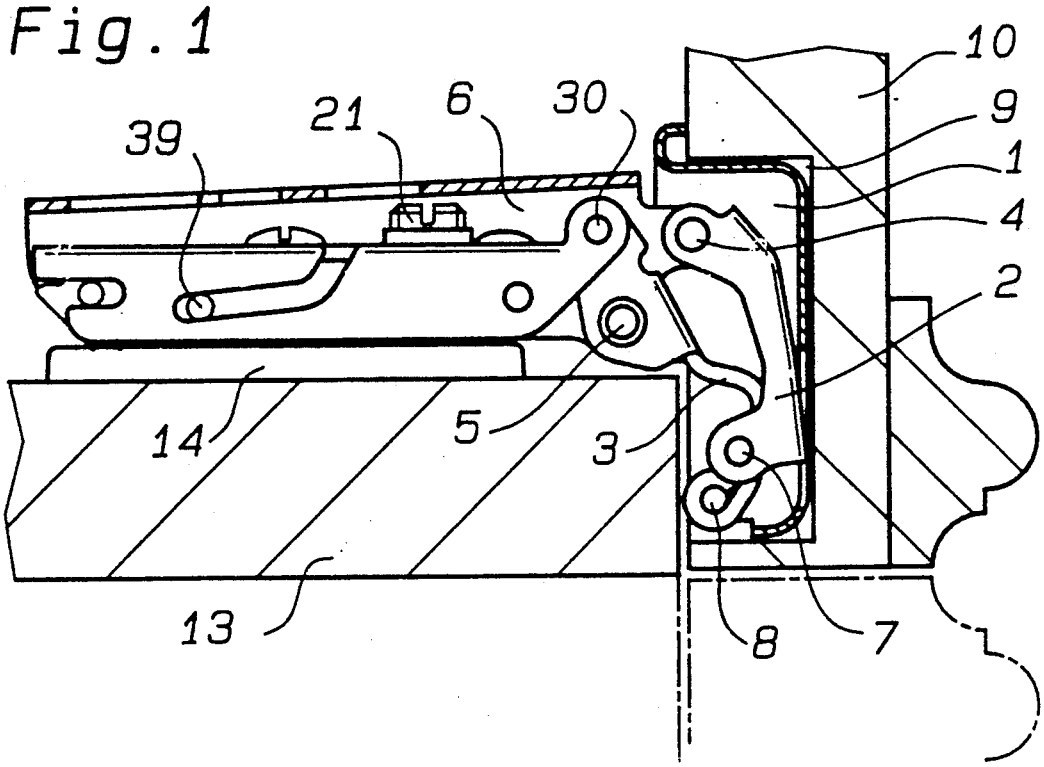
FIG. 1 is a side elevation view showing a first embodiment of the hinge in its closed position with the hinge bracket and the hinge member being shown in section.

Illustrative embodiments of the invention will now be described in more detail with reference to the drawing.

The hinge illustrated in FIGS. 1 to 8 comprises a hinged, cup-shaped hinge member 1, which by links 2, 3 and pivot pins 4, 5, is articulatedly connected in the usual manner to the channel-shaped hinge bracket 6. The outer ends of the links 2, 3 are pivoted on pivot pins 7, 8 in the cup-shaped hinge member 1. The hinged cup-shaped hinge member 1 is received in a milled bore 9 formed in the door 10 and is secured to the door 10 in the usual manner. The cup-shaped hinge member 1 constitutes the hinged part by which the door is fixed and may have any other suitable design. The inner link 3 is provided with an extension 11, which extends in length beyond the bore 12 and beyond the pivot pin 5.

Figure 3:
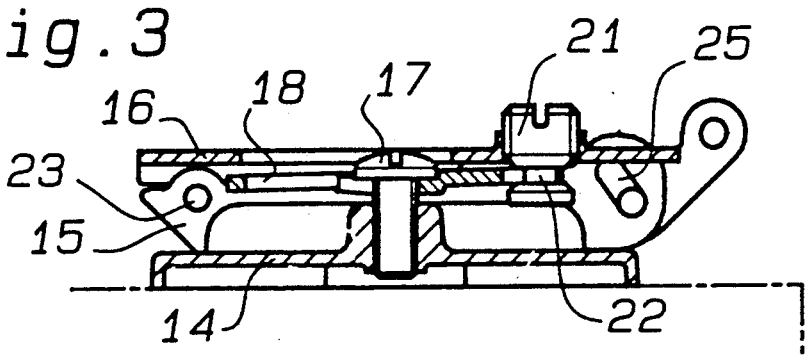
FIG. 3 is a longitudinal sectional view showing the mounting plate and two intermediate plates secured to the mounting plate in a position in which the hinge bracket is lifted.
Figure 5:
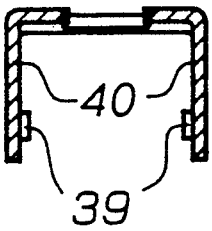
FIG. 5 is a transverse sectional view taken on line V—V in FIG. 4 and showing the hinge bracket.
Figure 4:
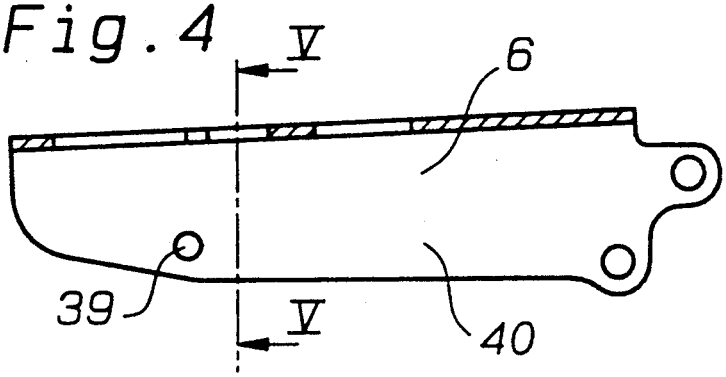
FIG. 4 is a longitudinal sectional view showing the hinge bracket.
Figure 6:
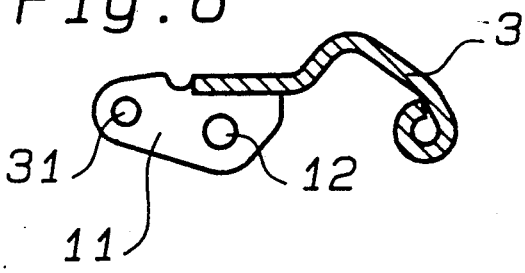
FIG. 6 is a longitudinal sectional view showing the inner link of the hinge shown in FIG. 1.
Figure 7:
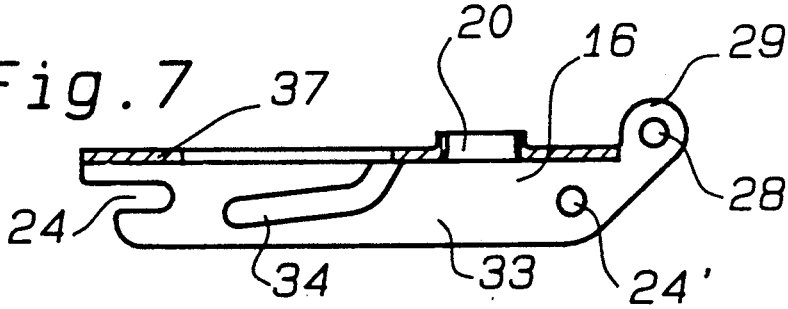
FIG. 7 is a longitudinal sectional view taken on line VII—VII in FIG. 8 and showing the first intermediate plate.
Figure 8:
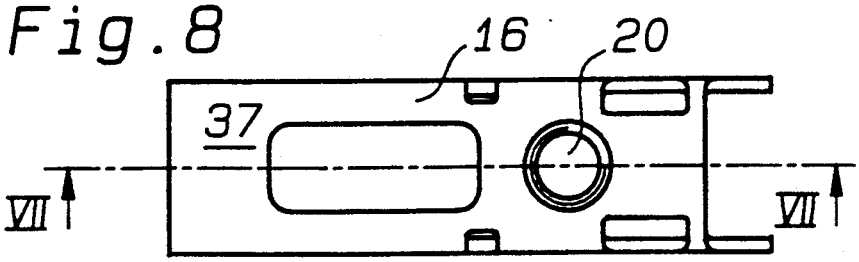
FIG. 8 is a top plan view showing the intermediate plate of FIG. 7.

A mounting plate 14 is connected by screws to the carrying wall 13, and as is apparent from FIG. 3, is connected to a first intermediate plate 15 and a second intermediate plate 16. The first intermediate plate 15 is channel-shaped and is connected to the mounting plate 14 by the fixing screw 17, which extends into a keyhole-shaped slot 18 in the web of the first intermediate plate 15. The slot 18 permits an adjustment of the hinge bracket 6 in its longitudinal direction.

The second intermediate plate 16 is mounted on the first intermediate plate 15 and is also channel-shaped. The adjusting screw 21 is screwed into the tapped flanged bore 20 of the web of the second intermediate plate 16 and is formed with an annular groove 22, which receives the web of the first intermediate plate 15 in a slot, which is open at its forward end. The rear portions of the flanges of the first intermediate plate 15 are provided with projecting pins 23, which are guided in the second intermediate plate 16 in slots 24 having open rear ends. The forward portions of the flanges of the intermediate plate 16 are provided with a bolt or with projecting pins 24', which extend into oblique slots 25 in the flanges of the first intermediate plate 15. Upon an adjustment effected by the adjusting screw 21, the second intermediate plate 16 will perform a pivotal movement and a superimposed translational movement so that a lateral adjustment of the door will not change the width of the gap between the door and the corpus part. That design is disclosed in German Patent Specification 34 42 421 and in the corresponding U.S. Pat. No. 4,701,979, the disclosure of which is incorporated herein by reference.

In connection with the invention, the term carrying plate is used to describe all components provided between the carrying wall and the hinge bracket. The hinge bracket may be carried only by a mounting plate or a carrying plate may be provided which consists of a mounting plate and at least one intermediate plate, by which the hinge bracket is carried.

The forward portions of the flanges of the second intermediate plate 16 are extended in their forward portions beyond the web of the plate 16 to constitute a forked portion 29, which is formed with bores 28. The extension 11 of the inner link 3 is pivoted in the bore 31 on the pin 30, which is held in the bores 28.

Slots 34 are formed in the flanges 33 of the second intermediate plate 16 and approximately in the intermediate portion of the intermediate plate 16 the slots have open upper ends in the web of the plate 16. Each slot 34 consists of a slightly inclined, straight rear portion 35 and an upwardly curved portion 36, which opens in the web 37 of the intermediate plate 16. The slot 35 receives pins 39, which are provided on the inside of the flanges 40 of the hinge bracket 6.

When the hinge is in its closed position shown in FIG. 1, the pins 39 of the hinge bracket 6 are disposed in the rear end portions of the slots 35. As the hinge is opened, the pins are shifted forwardly, as is apparent from FIG. 2.

It is apparent from FIG. 1 that during an opening movement of the door 10 the hinge bracket 6 will perform a pivotal movement in a sense which is opposite to that opening movement and will be displaced outwardly at the same time.

The course of the slots 35, the length of the extension 11 and the locations of the pivot pins and guide pins are so selected that the door being opened will perform the desired movement toward the outside and toward the inside so that the hinge-side end face 44 of the door 10 will clear the adjacent end face 45 of another door or of another structural part.

Figure 2:
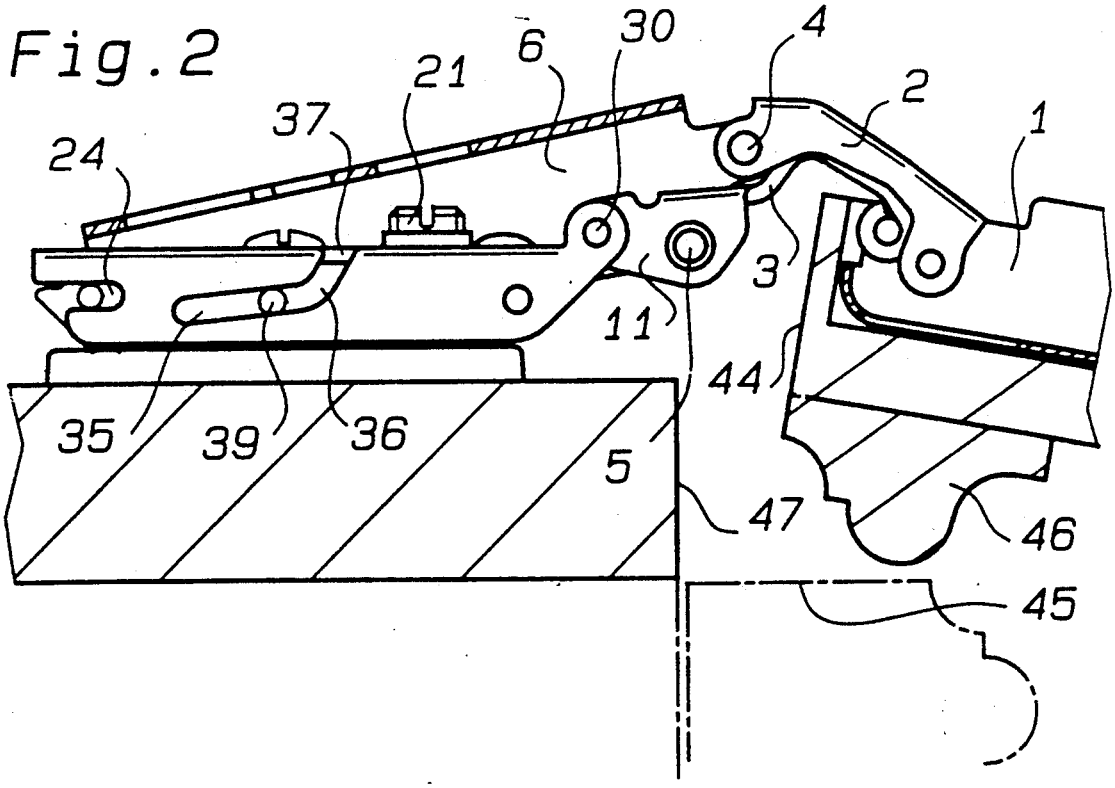
FIG. 2 is a side elevation view which is similar to FIG. 1 and shows the hinge in an open position.

It is apparent from FIG. 2 that the inward pivotal movement and outward displacement of the hinge bracket will result in the provision of a free space which is so large that even ornamental bars 46 can be pivotally moved without obstruction into the angle which is defined by the end face 45 of an adjacent door and the end face 47 of the carrying wall 13.

Figure 9:
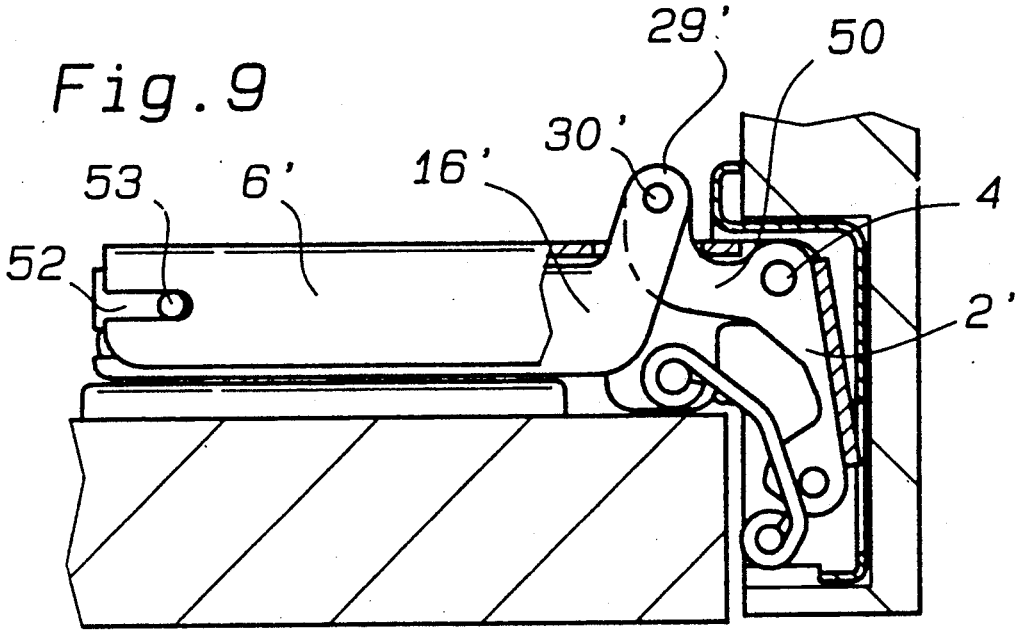
FIG. 9 is a side elevation view showing, partly in section, a second embodiment of the hinge in its closed position.
Figure 10:
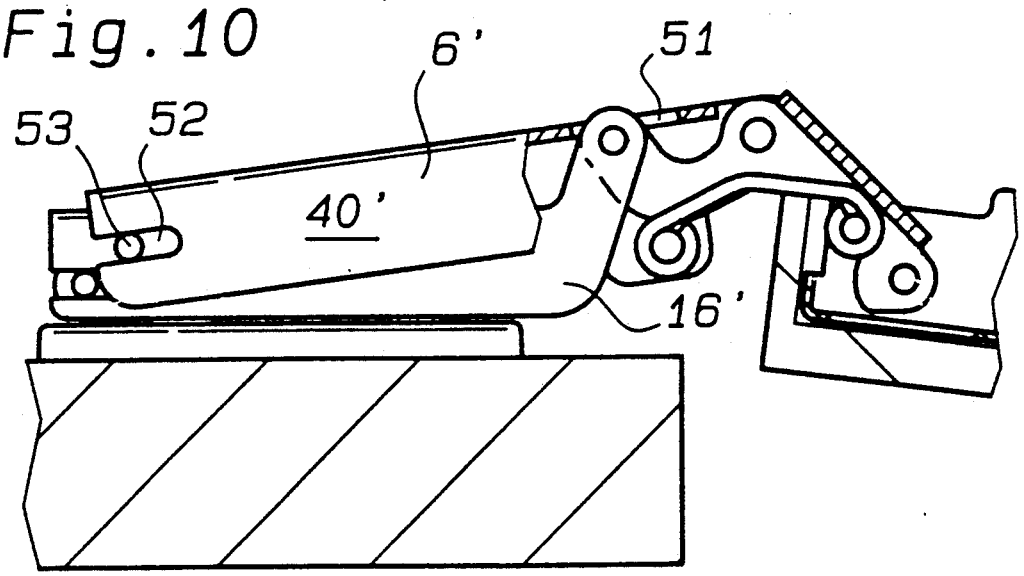
FIG. 10 is a view which is similar to FIG. 9 and shows the hinge which has been opened.
Figure 11:
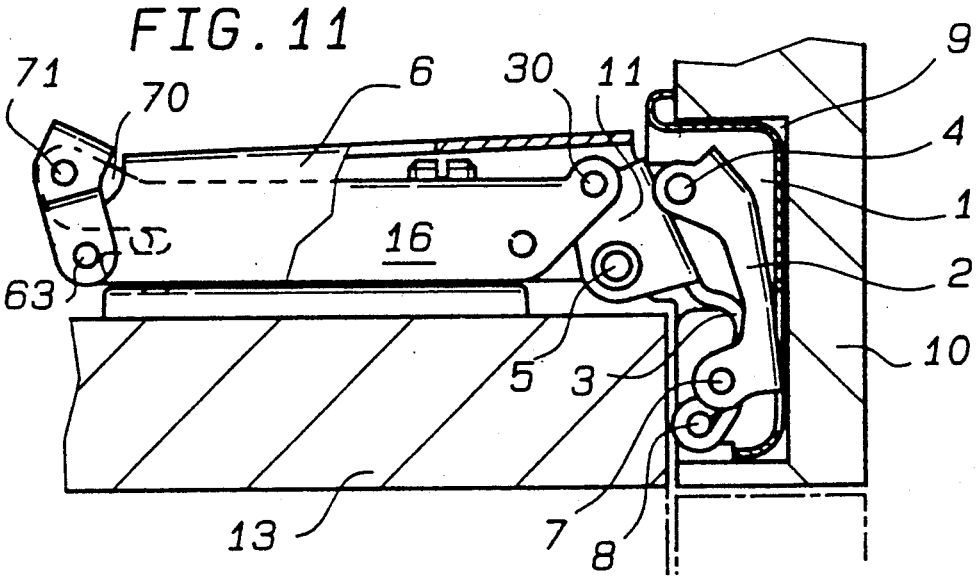
FIG. 11 is a side elevation view showing a further embodiment of the hinge with the hinge bracket and the hinge member shown in section and in the position assumed by the hinge when the door is closed.
Figure 13:
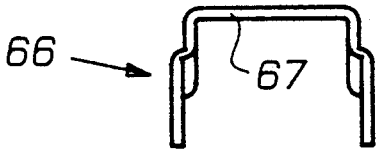
FIG. 13 is a front elevation view showing the coupling member by which the hinge bracket is articulatedly connected to the intermediate plate.
Figure 14:
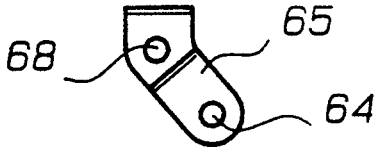
FIG. 14 is a side elevation view showing the coupling member of FIG. 13.
Figure 12:
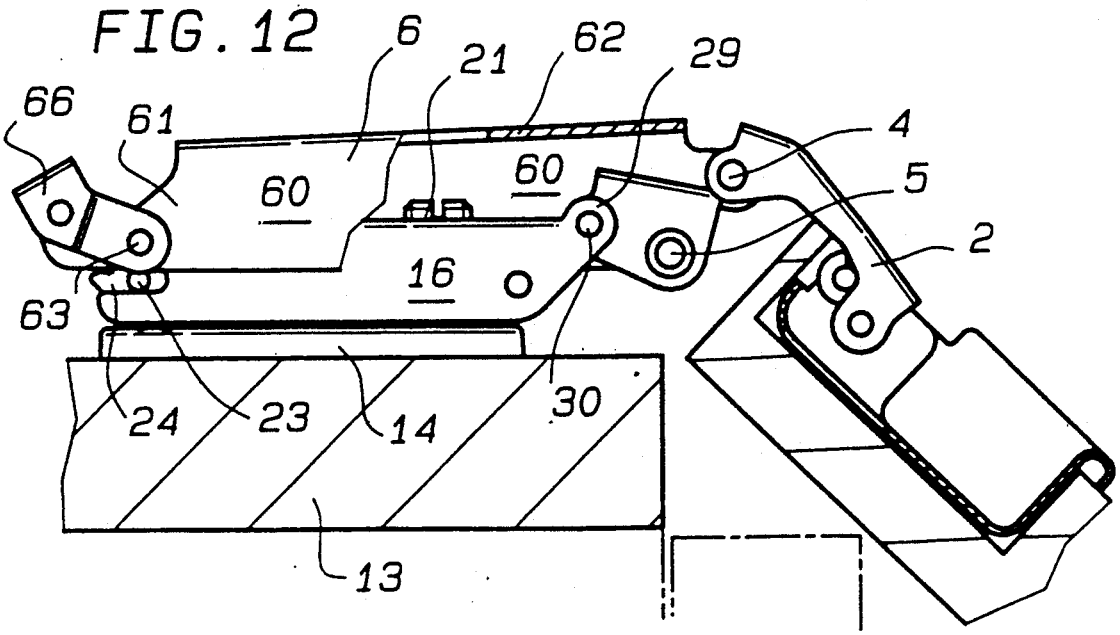
FIG. 12 is a side elevation view which is similar to FIG. 11 but shows the hinge in an open position.

The embodiment shown in FIGS. 9 and 10 differs from the one shown in FIGS. 1 to 8 in that the outer link 2' is provided with an extension 50, which is curved upwardly and extends beyond the pivot pin 4 and which is pivoted by the pivot pin 30' to the upwardly extended forklike portion 29' of the intermediate plate 16'. The pivot pin connecting the extension 50 to the forked portion 29' of the intermediate plate 16' extends through a windowlike aperture 51 in the web of the hinge bracket 6'.

The flanges 40' of the hinge bracket 6' are provided at their rear ends with slots 52, which are open at their rear ends. Guide pins 53 are secured to the flanges of the intermediate plate 16' on the outside and are guided in the slots 52.

In the embodiment shown in FIGS. 11 to 14, a carrying plate 14 is connected by screws to the carrying wall 13 and as is apparent from FIG. 3 is connected to a first intermediate plate and to a further intermediate plate 16. The first intermediate plate is also channel-shaped and is connected to the carrying plate 14 by a fixing screw, which extends through a slot in the web of the first intermediate plate. The second intermediate plate 16 is mounted on the first intermediate plate and is also channel-shaped. An adjusting screw 21 is screwed into a tapped flanged bore of the web of the second intermediate plate 16 and has an annular groove which receives the web of the first intermediate plate in a slot, which has an open forward end. The flanges of the first intermediate plate are provided in their rear portions with projecting pins 23, which are guided in slots 24, which are formed in the second intermediate plate 16 and have open rear ends. The forward portions of the flanges of the intermediate plate 16 are provided with a bolt or with projecting pins, which extend into inclined slots in the flanges of the first intermediate plate. Upon an adjustment effected by the adjusting screw 21, the second intermediate plate 16 will perform a pivotal movement and a superimposed translational movement so that a lateral adjustment of the door will not change the width of the gap between the door and the corpus part. That design is disclosed in German Patent Specification 34 42 421 and in the corresponding U.S. Pat. No. 4,701,979, the disclosure of which is incorporated herein by reference.

The forward portions of the flanges of the second intermediate plate 16 are extended in their forward portions beyond the web of the plate 16 to constitute a forked portion 29, which is formed with bores 28. The extension 11 of the inner link 3 is pivoted in the bore 31 on the pin 30, which is held in the bores 28.

The side flanges 60 of the hinge bracket 6 are provided with rearwardly directed length extensions 61, which protrude beyond the web 62 of the hinge bracket 6. The forklike extensions 61 are formed with bores, each of which receives a short riveted pin 63. The pins 63 extend through bores 64 formed in the legs 65 of the U-shaped coupling member 66 so that the latter is pivoted to the extensions 61. Close to the web 67 of the coupling member 66, the legs 65 of the latter are formed with additional bearing bores 68. The flanges 65 are provided with offset portions as is apparent from FIGS. 13 and 14.

The flanges of the channel-shaped intermediate plate 16 are provided at the rear with length extensions 70, which protrude also upwardly above the web of the intermediate plate 16 and thus form an extended and raised bearing fork for the coupling member 66. The rearwardly and upwardly extending extensions 70 are provided with bearing bores, in which a pivot pin 71 is held, which extends through the bearing bores 68 of the coupling member 66.

Because the hinge bracket 6 is articulatedly connected to the second intermediate plate 16 by the coupling member 66 and by the extension 11, a four-pivot linkage is provided, the pivots 5, 30 and 63, 71 of which lie at the corners of a parallelogram so that the hinge bracket 6 will be displaced inwardly substantially parallel to itself during an opening movement of the door 10.

We claim:

1. A hinge for hinging a door or flap to a carrying wall of a furniture corpus, comprising:

a cup-shaped hinge member;

a hinge bracket articulatedly connected to the hinge member by two links, each of said links connected, at one end, to said hinge member;

a carrying plate for mounting said hinge bracket on the carrying wall;

pivot pins for mounting each of said links on said hinge bracket; and a guide for movably mounting the hinge bracket, at one end, on the carrying plate, one of the two links having an extension which is extended in length beyond one of said pivot pins, said one of said pivot pins mounting said one link on the hinge bracket, said one link, at a free end of said extension, being articulatedly connected to the carrying plate so that a pivotal movement of the hinge member imparts to the hinge bracket both a displacement along said guide and a pivotal movement.

2. A hinge according to claim 1, characterized in that the two links include an inner link and an outer link, the inner link being provided with the extension.

3. A hinge according to claim 1, characterized in that the two links include an inner link and an outer link, the outer link being provided with the extension, in that said hinge bracket is channel-shaped and includes a web, the web of the hinge bracket being provided with an aperture, and in that the extension and a portion of the carrying plate which is connected to said extension extend through said aperture.

4. A hinge according to claim 1, characterized in that the guide is constituted by pins and open-ended slots, said open-ended slots being formed in side portions of the carrying plate and receiving said pins, which are secured to an inside of side flanges of the hinge bracket.

5. A hinge according to claim 1, characterized in that the guide is constituted by open-ended slots, which are formed in flanges of the hinge bracket and receive lateral pins of the carrying plate.

6. A hinge according to claim 1, characterized in that the carrying plate includes a mounting plate and an intermediate plate, which is adjustably connected to the mounting plate, the extension of the one link being connected to the intermediate plate, and the hinge bracket being guided on the intermediate plate.

7. A hinge according to claim 1, and further comprising a coupling member which, adjacent to a rear end of the hinge bracket, is articulatedly connected to the hinge bracket and to the carrying plate, said coupling member having such a length that during a pivotal movement of the hinge member to an open position, the hinge bracket performs a pivotal movement and, during said pivotal movement remains substantially parallel to the carrying plate.

8. A hinge according to claim 7, characterized in that in a closed position of the hinge, an articulated connection between the coupling member and the hinge bracket is closer to a surface on which the carrying plate is mounted than an articulated connection between the coupling member and the carrying plate.

9. A hinge according to claim 7, characterized in that a distance between pivotal axes of the coupling member is approximately as large as a distance from a pivotal axis disposed adjacent to the free end of the extension to the pivotal axis on which said one link is connected to the carrying plate.

10. A hinge according to claim 7, characterized in that the coupling member is pivoted to a rising rear portion of the carrying plate.

11. A hinge according to claim 7, characterized in that the coupling member and the extension are approximately parallel to each other.

12. A hinge according to claim 7, characterized in that pivotal axes of the coupling member and of the extension lie at corners of a parallelogram.

13. A hinge according to claim 7, characterized in that the coupling member includes a U-shaped member having a web and legs, formed with bores for an articulated connection to the hinge bracket and the carrying plate, said legs being pivoted, adjacent to the web, to the carrying plate.

* * * * *